US007264601B2

(12) United States Patent
Liao

(10) Patent No.: US 7,264,601 B2
(45) Date of Patent: Sep. 4, 2007

(54) SPINE MASSAGER USING INFLATABLE BLADDERS

(76) Inventor: Bi-Chih Liao, 4F., No. 272, Sec. 4, Chengde Rd., Shihlin District, Taipei City 111 (TW)

( * ) Notice: Subject to any disclaimer, the term of this patent is extended or adjusted under 35 U.S.C. 154(b) by 415 days.

(21) Appl. No.: 11/039,797

(22) Filed: Jan. 24, 2005

(65) Prior Publication Data

US 2005/0228321 A1 Oct. 13, 2005

(30) Foreign Application Priority Data

Apr. 13, 2004 (TW) ..... 93205635 U

(51) Int. Cl.
*A61H 1/02* (2006.01)
*A61H 23/04* (2006.01)

(52) U.S. Cl. ..... 601/149; 601/150

(58) Field of Classification Search ..... 601/148–152; 128/DIG. 20; 297/284.6, 284.3, 452.41; 5/615, 710; 602/13
See application file for complete search history.

(56) References Cited

U.S. PATENT DOCUMENTS 3,595,223 A * 7/1971 Castagna ..... 601/55
3,613,671 A * 10/1971 Poor et al. ..... 601/149
5,211,162 A * 5/1993 Gillen et al. ..... 601/149
5,233,974 A * 8/1993 Senoue et al. ..... 601/149
5,611,772 A * 3/1997 Fujimoto et al. ..... 601/149
5,906,586 A * 5/1999 Graham ..... 602/32
6,203,105 B1 * 3/2001 Rhodes, Jr. ..... 297/284.6
6,361,512 B1 * 3/2002 Mackay et al. ..... 601/150
2002/0091345 A1 * 7/2002 Hazard ..... 601/148
2004/0097854 A1 * 5/2004 Hester et al. ..... 601/149
2004/0204742 A1 * 10/2004 Graham et al. ..... 606/240
2004/0260217 A1 * 12/2004 Gardner et al. ..... 601/148

FOREIGN PATENT DOCUMENTS

JP 4-266757 * 9/1992

* cited by examiner

*Primary Examiner*—Danton DeMille
(74) *Attorney, Agent, or Firm*—Troxell Law Office PLLC

(57) ABSTRACT

A spine massager is disclosed to include a master air bladder, two supplementary air bladders bilaterally provided at the top side of the master air bladder, and a pressure control unit formed of a switch pressure switch and a second pressure switch and connectable to an external air pump for inflating the air bladders in such a manger that the two supplementary air bladders are alternatively inflated and exhausted after the master air bladder has been inflated to the saturated status.

6 Claims, 2 Drawing Sheets

SPINE MASSAGER USING INFLATABLE BLADDERS

BACKGROUND OF THE INVENTION

1. Field of the Invention

The present invention relates to a massager and more particularly, to a spine massager, which comprises a master air bladder, two supplementary air bladders bilaterally provided at the top side of the master air bladder, and pressure switch means adapted to inflate and exhaust the two supplementary air bladders alternatively after having inflated the master air bladder to the saturated status.

2. Description of the Related Art

Conventional massaging apparatus commonly use rollers for massaging the joints of the spine. When electrically connected, the rollers are rotated and moved over a part of the user's back to massage the joints of the spine. These massaging apparatus cannot stretch the user's spine to achieve a satisfactory spine massaging effect.

U.S. Pat. No. 6,202,237, entitled "BED HAVING MASSAGE DEVICE", provides a bed having a number of holes for receiving a number of pneumatic actuating devices, such as the air bag type or the bellows type pneumatic actuating devices. An air pump supplies a pressurized air to the pneumatic actuating devices via a number of air valves to actuate the pneumatic actuating devices to act on the users. This design cannot lift or stretch the user's spine.

U.S. Pat. No. 5,848,982, entitled "LOUNGER-TYPE AIR MASSAGER", provides a massaging device, which comprises a lounger body including a seat portion and a backrest portion provided on the rear end of the seat portion, bags provided in the seat portion and the backrest portion and adapted to inflate and deflate when compressed air is fed thereinto and discharged therefrom, and a compressed air control device for controlling the feed and discharge of the compressed air into and from the bags. The bag in the seat portion is fixed at its rear edge portion on the backrest side to the seat portion, and the bag in the backrest portion is fixed at its upper end portion to the backrest portion. The compressed air control device changes the charging time or exhaust time for the compressed air, the capacity of each bag, or the flow resistance of a charging/exhaust pipe for each bag so as to make the bag among the bags, which is subjected to a heavier load from the body weight of a person seated on the lounger body than the other bag, has the same inflation as the inflation of the other bag after the feed of the compressed air into those bags is finished. This design of massaging device does not,stretch the user's spine by lifting it.

U.S. Pat. No. 5,792,082, entitled "A CHAIR-TYPE AIR MASSAGER DEVICE", provides an air massage device which has inflatable and deflatable air bags for massaging a user's body part by air pressure causing an expansion and contraction of the air bags. The air bags of this design of massage device includes air bags for a neck massage, air bags for a back massage and air bags for a waist massage, air bags for a buttocks massage, and air bags-for a thigh massage. However, because this design is a chair-type, it does not lift the user's spine to give a stretch.

U.S. Pat. No. 5,170,522, entitled "AIR ADJUSTABLE BED", provides an adjustable bed, which has a foundation for supporting an air mattress. The foundation has a plurality of pivotally connected transverse plates that are moved to bend the mattress to a desired contour and shape. Open top recesses in the foundation located below the plates accommodate bags have flexible walls. The bags are separately expandable and contractible to move the plates to selected elevated positions. The recesses hold the bags in lifting positions relative to the plates when the bags are inflated. The bags fit into the recesses when deflated to allow the plates to move to a horizontal position. The bed is equipped with a vibrator that is operable to vibrate the air mattress. This design simply works to lift the user's head and/or legs. It does not lift the user's spine to give a stretch.

SUMMARY OF THE INVENTION

The present invention has been accomplished under the circumstances in view. It is the main object of the present invention to provide a spine massager, which massages the joints of the user's spine by means of alternatively inflating and exhausting air bladders to stretch different portions of the spine. To achieve this and other objects of the present invention, the spine massager comprises a master air bladder, the master air bladder having a top side, an air chamber defined under the top side, and a valve hole for guiding in air to inflate the air chamber of the master air bladder; a first supplementary air bladder provided at the top side of the master air bladder, the first supplementary air bladder having an air chamber and a valve hole for guiding in air to inflate the air chamber of the first supplementary air bladder; a second supplementary air bladder provided at the top side of the master air bladder and at one lateral side of the first supplementary air bladder, the second supplementary air bladder having an air chamber and a valve hole for guiding in air to inflate the air chamber of the second supplementary air bladder; and a pressure control means connected to the valve hole of the master air bladder and the valve hole of the first supplementary air bladder and the valve hole of the second supplementary air bladder and connectable to an external air pump for guiding in compressed air to the master air bladder and the first supplementary air bladder and the second supplementary air bladder and adapted to alternatively inflate and exhaust the first supplementary air bladder and the second supplementary air bladder after the master air bladder has been inflated to a saturated status, the pressure control means comprising a first pressure switch means and a second pressure switch means, the first pressure switch means comprising a first switching port connected to the valve hole of the master air bladder, a second switching port connected to the second pressure switch means, and a third switching port connectable to an external air pump, the second pressure switch means comprising a first switching port connected to the valve hole of the first supplementary air bladder, a second switching port connected to the valve hole of the second supplementary air bladder, a third switching port connected to the second switching port of the first pressure switch means, and a fourth switching port connected to the atmosphere

BRIEF DESCRIPTION OF THE DRAWINGS

FIG. 2(*b*) is a schematic drawing showing the spine massager of the present invention in action (II).

FIG. 2(*c*) is a schematic drawing showing the spine massager of the present invention in action (III).

FIG. 2(*d*) is a schematic drawing showing the spine massager of the present invention in action (IV).

DETAILED DESCRIPTION OF THE PREFERRED EMBODIMENT

Figure 1:
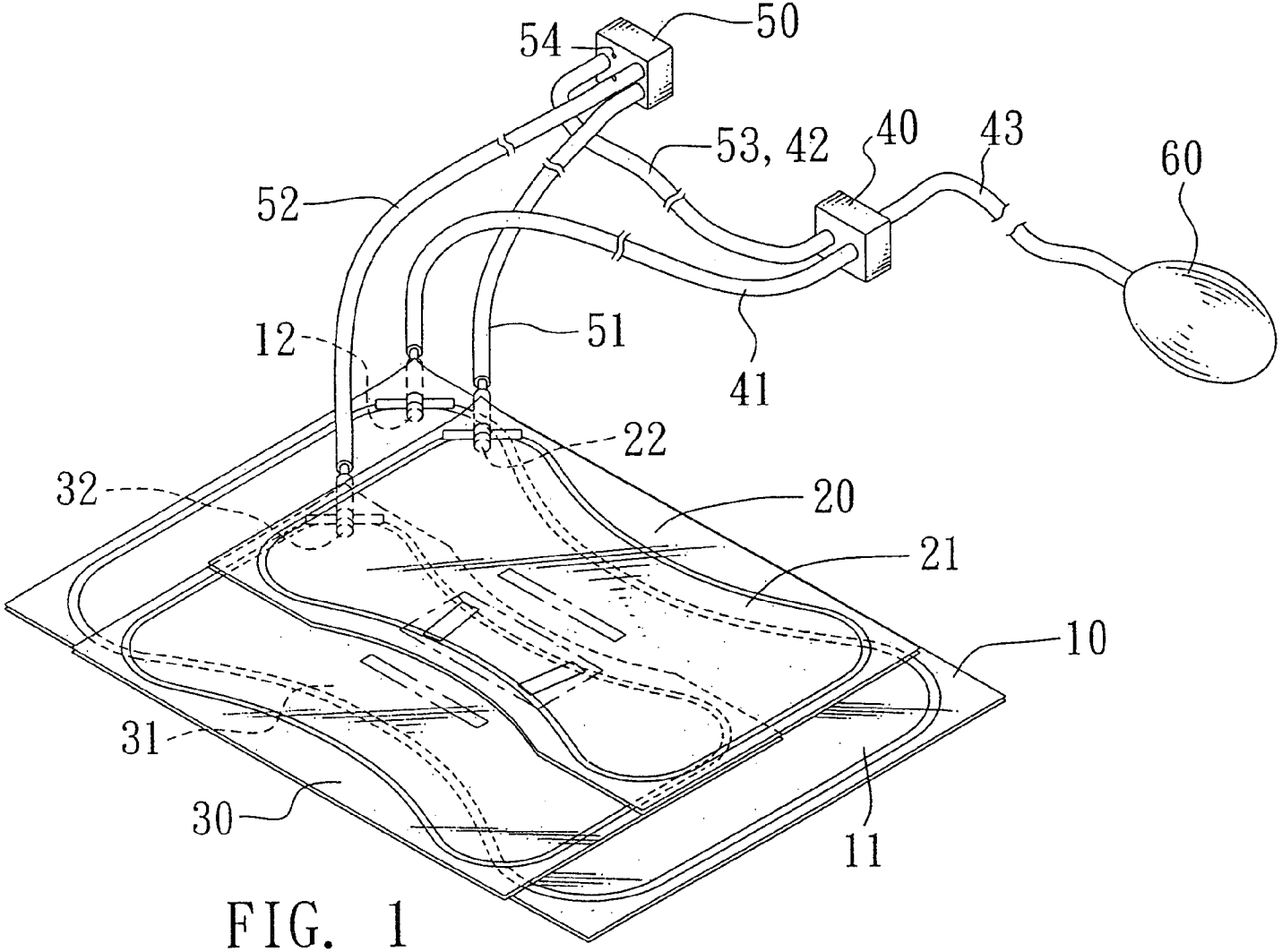
FIG. 1 is a schematic drawing show a spine massager according to the present invention.
Figure 2A:
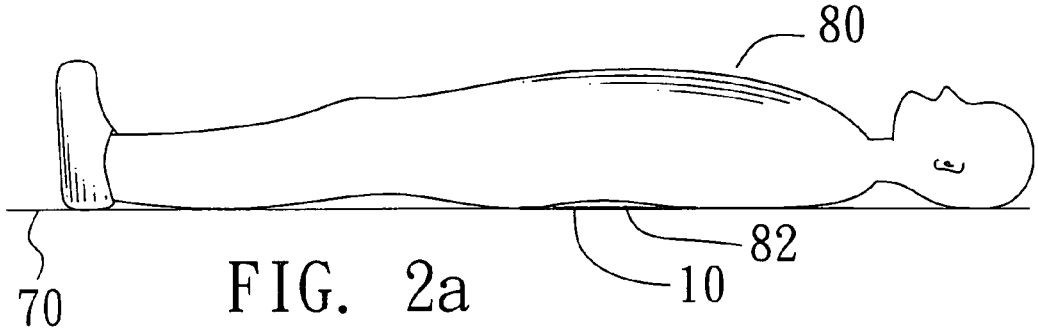
FIG. 2(*a*) is a schematic drawing showing the spine massager of the present invention in action (I).
Figure 2B:
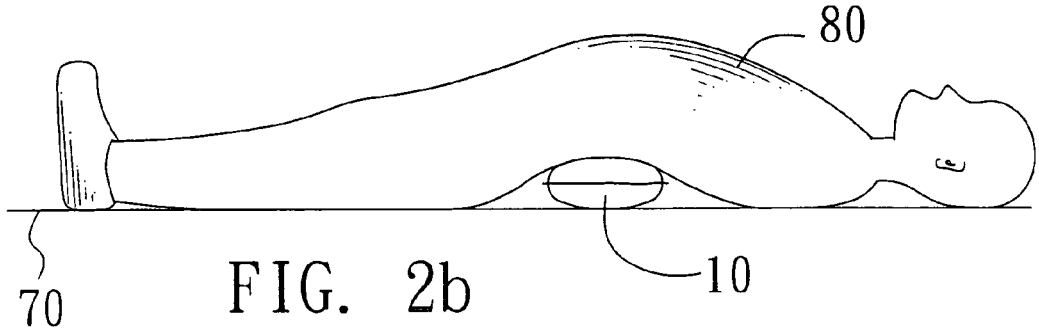
Figure 2C:
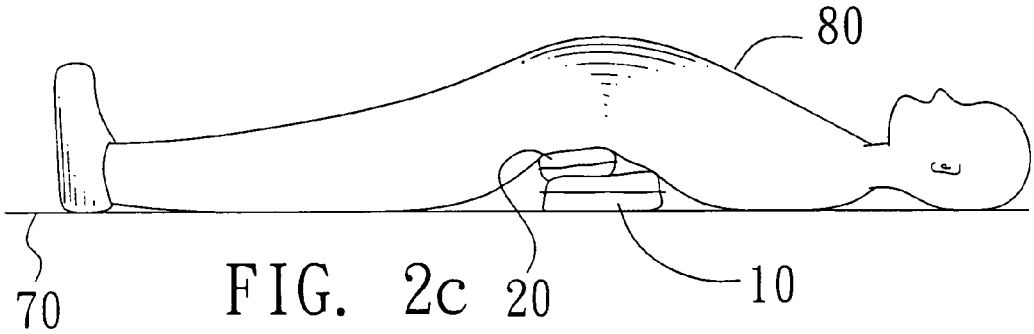
Figure 2D:
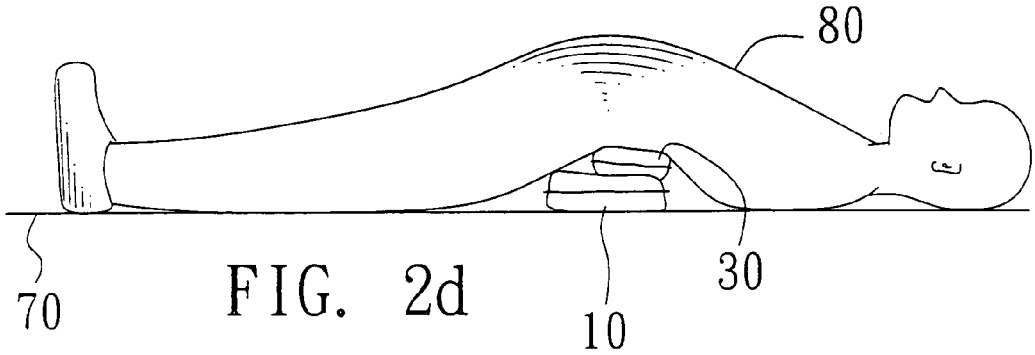

Referring to FIG. 1, a spine massager in accordance with the present invention is shown comprised of a master air bladder 10, a first supplementary air bladder 20, a second supplementary air bladder 30, a first pressure switch 40, and a second pressure switch 50.

The master air bladder 10 has an air chamber 11 and a valve hole 12. The master air bladder 10 can be made in any of a variety of shapes, for example, a rectangular shape. According to this embodiment, the valve hole 12 is disposed in one corner of the air chamber 11. The first supplementary air bladder 20 is provided at the top side of the master air bladder 10, having an air chamber 21 and a valve hole 22 in one corner of the air chamber 21.The second supplementary air bladder 30 is provided at the top side of the master air bladder 19 and at one lateral side of the first supplementary air bladder 20, having an air chamber 31 and a valve hole 32 in one corner of the air chamber 31. Preferably, the first supplementary air bladder 20 and the second supplementary air bladder 30 have a respectively part overlapped on each other.

The volume of the air chamber 21 of the first supplementary air bladder 20 is approximately equal to the air chamber 31 of the second supplementary air bladder 30 but smaller than the air chamber 11 of the master air bladder 10. The master air bladder 10, the first supplementary air bladder 20 and the second supplementary air bladder 30 are made from plastics, and sealed by a high-frequency sealing apparatus to for the respective air chambers 11, 21, 31.

The first pressure switch 40 has a first air tube 41 connected to the valve hole 12 of the master air bladder 10, a second air tube 42 connected to the second pressure switch 50, and a third air tube 43 connected to an external air pump 60. The second pressure switch 50 has a first air tube 51 connected to the valve hole 22 of the first supplementary air bladder 20, a second air tube 52 connected to the valve hole 32 of the second supplementary air bladder 30, a third air tube 53 connected to the first pressure switch 40, and an exhaust hole 54. According to the present preferred embodiment, the second air tube 42 of the first pressure switch 40 and the second air tube 52 of the second pressure switch 50 are the same air tube.

The operation of the spine massager is outlined hereinafter with reference to FIGS. 2(*a*) through 2(*d*) and FIG. 1 again. As shown in FIG. 2(*a*), the user 80 is lying on the floor or a flat surface 70, and then the spine massager is inserted into the gap 82 between the user's back and the flat surface 70. At this time, the spine of the user 80 rests at full length.

Thereafter, as shown in FIG. 2(*b*), the third air tube 43 of the first pressure switch 40 is connected to the external air pump 80, and then the air pump 80 is operated to pump air into the valve hole 12 to inflate the air chamber 11 of the master air bladder 10. When the air chamber 11 of the master air bladder 10 reached the saturated status, the air pressure of the master air bladder 10 forces the first pressure switch 40 to switch off the valve (not shown) to the master air bladder 10 and to switch on the valve (not shown) to the first supplementary air bladder 20, for enabling compressed air to pass from the air pump 80 to the air hole 22 of the first supplementary bladder 20 and to inflate the air chamber 21 of the first supplementary bladder 20. At this time, the spine of the user 80 is forced by the inflated master air bladder 10 to curve upwards.

Referring to FIG. 2(*c*), after the air chamber 21 of the first supplementary air bladder 20 has been inflated to the saturated status, the air pressure of the first supplementary air bladder 20 forces the second pressure switch 50 to switch off the valve (not shown) to the fist supplementary air bladder 20. At this time, the spine of the user 80 is forced by the inflated first supplementary air bladder 20 to curve upwards further.

Referring to FIG. 2(*d*), immediately after the second pressure switch 50 switched off the valve to the first supplementary air bladder 20, the second pressure switch 50 switches on the valve (not shown) to the second supplementary air bladder 30 to let compressed air pass from the air pump 80 to the air hole 32 of the second supplementary bladder 30 and to inflate the air chamber 31 of the second supplementary bladder 30, and simultaneously to let air be exhausted from the air chamber 21 of the first supplementary air bladder 20 through the exhaust hole 54. At this time, the spine of the user 80 is forced to curve upwards at another location by the inflated second supplementary air bladder 30. After the second supplementary air bladder 30 has been inflated to the saturated status, the air pressure of the second supplementary air bladder 30 forces the second pressure switch 50 to switch on the valve to the air chamber 21 of the first supplementary air bladder 20 to inflate the first supplementary air bladder 20 and simultaneously to let air be exhausted from the air chamber 31 of the second supplementary air bladder 30 through the exhaust hole 54.

As indicated above, during the use of the present invention, the master air bladder 10 is constantly kept in the saturated status, the first supplementary air bladder 20 and the second supplementary air bladder 30 are alternatively inflated and exhausted to stretch the user's spine alternatively, thereby effectively massaging the joints of the user's spine.

Although a particular embodiment of the invention has been described in detail for purposes of illustration, various modifications and enhancements may be made without departing from the spirit and scope of the invention.

What the invention claimed is:

1. A spine massager comprising:

a master air bladder, said master air bladder having a top side, an air chamber defined under said top side, and a valve hole for guiding in air to inflate the air chamber of said master air bladder;

a first supplementary air bladder provided at the top side of said master air bladder, said first supplementary air bladder having an air chamber and a valve hole for guiding in air to inflate the air chamber of said first supplementary air bladder;

a second supplementary air bladder provided at the top side of said master air bladder and at one lateral side of said first supplementary air bladder, said second supplementary air bladder having an air chamber and a valve hole for guiding in air to inflate the air chamber of said second supplementary air bladder; and a pressure control means connected to the valve hole of said master air bladder and the valve hole of said first supplementary air bladder and the valve hole of said second supplementary air bladder and connectable to an external air pump for guiding in compressed air to said master air bladder and said first supplementary air bladder and said second supplementary air bladder and adapted to alternatively inflate and exhaust said first supplementary air bladder and said second supplementary air bladder after said master air bladder has been inflated to a saturated status, said pressure control means comprising a first pressure switch means and a second pressure switch means, said first pressure switch means comprising a first switching port connected to the valve hole of said master air bladder, a second switching port connected to said second pressure switch means, and a third switching port connectable to an external air pump, said second pressure switch means comprising a first switching port connected to the valve hole of said first supplementary air bladder, a second switching port connected to the valve hole of said second supplementary air bladder, a third switching port connected to the second switching port of said first pressure switch means, and a fourth switching port connected to the atmosphere.

2. The spine massager as claimed in claim 1, wherein the volume of the air chamber of said first supplementary air bladder is approximately equal to the air chamber of said second supplementary air bladder but smaller than the air chamber of said master air bladder.

3. The spine massager as claimed in claim 1, wherein said first air bladder and said second air bladder are partially overlapped on each other.

4. The spine massager as claimed in claim 1, wherein said master air bladder is made from plastics and sealed by a high-frequency sealing apparatus to form the air chamber of said master air bladder.

5. The spine massager as claimed in claim 1, wherein said first supplementary air bladder is made from plastics and sealed by a high-frequency sealing apparatus to form the air chamber of said first supplementary air bladder.

6. The spine massager as claimed in claim 1, wherein said second supplementary air bladder is made from plastics and sealed by a high-frequency sealing apparatus to form the air chamber of said second supplementary air bladder.

* * * * *